US010287092B2

(12) United States Patent
Daubert et al.

(10) Patent No.: US 10,287,092 B2
(45) Date of Patent: May 14, 2019

(54) LIQUID CONTAINMENT STRUCTURES AND FRAC PONDS WITH MAT FOUNDATIONS

(71) Applicant: A.O.S Services Ltd., Grande Prairie (CA)

(72) Inventors: Dustin Daubert, Grande Prairie (CA); Brian Daubert, Grande Prairie (CA)

(73) Assignee: A.O.S SERVICES LTD., Grande Prairie (CA)

( * ) Notice: Subject to any disclaimer, the term of this patent is extended or adjusted under 35 U.S.C. 154(b) by 60 days.

(21) Appl. No.: 15/279,081

(22) Filed: Sep. 28, 2016

(65) Prior Publication Data

US 2017/0088346 A1 Mar. 30, 2017

Related U.S. Application Data

(60) Provisional application No. 62/233,893, filed on Sep. 28, 2015.

(51) Int. Cl.

| | |
|---|---|
| ***E21B 27/00*** | (2006.01) |
| ***E21B 43/26*** | (2006.01) |
| ***B65D 90/24*** | (2006.01) |
| ***B65D 90/04*** | (2006.01) |
| ***B65D 90/02*** | (2019.01) |

(52) U.S. Cl.
CPC ..... *B65D 90/24* (2013.01); *B65D 90/023* (2013.01); *B65D 90/046* (2013.01)

(58) Field of Classification Search
CPC ..... E21B 27/00; E21B 43/26
See application file for complete search history.

(56) References Cited

U.S. PATENT DOCUMENTS

| | | | |
|---|---|---|---|
| 3,975,874 | A | 8/1976 | Witte et al. |
| 4,152,875 | A | 5/1979 | Soland |
| 4,167,599 | A | 9/1979 | Nissinen |
| 4,600,336 | A | 7/1986 | Waller, Jr. |
| 5,462,655 | A | 10/1995 | Ladd et al. |

(Continued)

FOREIGN PATENT DOCUMENTS

| | | |
|---|---|---|
| BE | 898950 | 6/1984 |
| CA | 2176273 | 8/1997 |

(Continued)

OTHER PUBLICATIONS

Terrapro HD Containment System at a Glance!, URL=http://www.terraprohd.com/road-mats-rig-mats/, accessed on Nov. 2, 2015, published at least as early as Mar. 8, 2015, 4 pages.

(Continued)

*Primary Examiner* — Catherine Loikith
(74) *Attorney, Agent, or Firm* — Robert A. Nissen

(57) ABSTRACT

A liquid containment structure such as a frac pond has a perimeter wall; a floor liner bounded by the perimeter wall; and a platform underneath the floor liner, the platform formed of a plurality of mats laid edge to edge and whose upper faces collectively define a support surface. Related methods of use of the structure include installing the structure at a well site, and in some cases using the structure as a frac water pond. A drain channel may be defined in the support surface below a portion of the floor liner, with the portion of the floor liner extending downward into the drain channel.

18 Claims, 8 Drawing Sheets

(56) References Cited

U.S. PATENT DOCUMENTS

| | | | | |
|---|---|---|---|---|
| 5,738,139 | A | 4/1998 | DeChard | |
| 5,822,944 | A | 10/1998 | Penland, Sr. | |
| 5,833,386 | A | 11/1998 | Rosan et al. | |
| 6,474,905 | B1 | 11/2002 | Smith, Jr. et al. | |
| 6,648,008 | B1 | 11/2003 | Price | |
| 7,604,431 | B2 | 10/2009 | Fournier | |
| 8,500,941 | B2 | 8/2013 | Whitener | |
| 8,870,492 | B2 | 10/2014 | Stasiewich et al. | |
| 2004/0244320 | A1 | 12/2004 | Kalisiak et al. | |
| 2009/0151791 | A1 | 6/2009 | Perkins | |
| 2010/0235979 | A1 | 9/2010 | Pesta | |
| 2012/0073831 | A1 | 3/2012 | Gibbens et al. | |
| 2012/0258267 | A1 | 10/2012 | Kroll et al. | |
| 2013/0048630 | A1 | 2/2013 | Zajicek et al. | |
| 2014/0083998 | A1 | 3/2014 | McGuire | |
| 2014/0248085 | A1 | 9/2014 | Zajicek et al. | |
| 2015/0129162 | A1* | 5/2015 | Hoffman | F28D 1/0213 165/45 |
| 2015/0132534 | A1 | 5/2015 | Ingalls | |
| 2015/0167310 | A1 | 6/2015 | Stanaland | |
| 2015/0233065 | A1 | 8/2015 | Downing | |
| 2016/0153161 | A1* | 6/2016 | Weinstein | E02D 19/18 405/129.6 |

FOREIGN PATENT DOCUMENTS

| | | |
|---|---|---|
| CA | 2390828 | 5/2012 |
| CA | 2776171 | 7/2013 |
| CA | 2777161 | 8/2014 |
| CH | 594106 | 12/1977 |
| DE | 3339345 | 5/1985 |
| DE | 10255220 | 6/2004 |
| DE | 102009016326 | 10/2010 |
| EP | 0085196 | 8/1983 |
| EP | 0117707 | 9/1984 |
| FR | 2436860 | 4/1980 |
| FR | 2812839 | 2/2002 |
| FR | 2892138 | 4/2007 |
| GB | 2466667 | 7/2010 |
| JP | S63210306 | 9/1988 |
| NL | 1006648 | 1/1999 |
| WO | 9925496 | 5/1999 |
| WO | 2015069564 | 5/2015 |

OTHER PUBLICATIONS

Aire Industrial Duck Pond Portable Containment Amazon Page, URL=http://www.amazon.com/AIREINDUSTRIAL918020304YPortableContainment/dp/B00GMH5D7K, published at least as early as Jul. 27, 2015, 4 pages.
Husky® Portable Containment—Secondary Containment and Recovery Berms, URL=http://www.huskyportable.com/husky-portable-berms_id52.html, published at least as early as Jul. 27, 2015, 3 pages.
Frac Tanks—Western Manufacturing Ltd. URL=Sep. 16, 2015, 4 pages.
Layfield Aboveground Synthetically-lined Wall Storage Systems Brochure, published at least as early as May 30, 2014, 12 pages.
Strad Product Brochure, published at least as early as Sep. 16, 2015, 12 pages.
TERRAPRO™ HD Composite Rig Mat Blog, URL=http://www.terraprohd.com/roadmatrigmatblog/, accessed on Sep. 9, 2015, 7 pages.
TERRAPRO HD Composite Rig Mat Brochure 2015, published at least as early as Sep. 9, 2015, 2 pages.
CrossLam by Structurlam product brochure, published at least as early as Sep. 8, 2015, 20 pages.
A safer mobile pond, from factory to frack site, URL=http://eaglefordtexas.com/news/id/134556/safermobilepondfactoryfracksite/, accessed on Sep. 8, 2015, 4 pages.
Sunray & Aries Round Pool Installation Manual, published at least as early as Sep. 8, 2015, 25 pages.
Equator Inground Steel Wall Pool Usage and Installation Manual, published at least as early as Sep. 8, 2015, 44 pages.
iPool Above Ground Exercise Pool by FitMax, URL=https://www.activeforever.com/ipool-above-ground-exercise-pool-by-fitmax, accessed on Sep. 8, 2015, 2 pages.
Bestway Ground Cover Mat for Fast Set Pool, URL=http://www.shoppingsquare.com.au/p_9926_Bestway_Ground_Cover_Mat_for_Fast_Set_Pool_366cm, published at least as early as Sep. 8, 2015, 2 pages.
Husky® Portable Containment—Protective Ground Covers, URL=http://www.huskyportable.com/husky-portable-gound-covers_id71.html, accessed on Sep. 8, 2015, 3 pages.
Ready L Bracket Spill Berm Quality Made in USAReady Containment, http://readycontainment.com/products/spill-containment/spill-berm/, accessed on Sep. 8, 2015, 5 pages.
Duramat™ Unilock Commercial, URL=http://commercial.unilock.com/products/permeable-pavements/dura-mat/?region=1, accessed on Sep. 8, 2015, 5 pages.
SiteSaver Installations, URL=http://thesitesaver.com/Installations.html, accessed on Sep. 8, 2015, 1 page.
Energy Supply Access Mats, URL=http://www.84energysupply.com/#filter=.crane, accessed on Sep. 8, 2015, 2 pages.
TERRAPRO™ HD Composite Rig Mat Features, URL=http://www.terraprohd.com/roadmatsrigmatsfeatures/, accessed an Sep. 8, 2015, 5 pages.
Wayback machine archive of Pool supplies Canada above ground pool photo, URL=http://web.archive.org/web/20150703002643/http://www.poolsuppliescanada.ca/index.php?dispatch=news.list/ published at least as early as Jul. 3, 2015, 21 pages.
Pool Supplies Canada—Above Ground Liners, URL=http://www.poolsuppliescanada.ca/liners/above-ground-liners/, accessed on Sep. 8, 2015, 4 pages.
MyTiCon Timber Connectors—Heavy Timber RAMPA Inserts Brochure, published at least as early as Aug. 27, 2015, 9 pages.
Black Diamond Energy Services—Frac Water Storage Pond, published at least as early as Jul. 24, 2015, 2 pages.
Strad EcoPond Specification Brochure, published at least as early as Jul. 24, 2015, 2 pages.
Seneca Resources—Being Good Stewards, URL=http://www.naffuel.com/seneca/good_stewards.aspx, accessed on Jul. 21, 2015, 2 pages.
Secure Energy Frac Ponds Pricing List, URL=http://www.secure-energy.com/our-services/integrated-water-solutions-0/frac-ponds, accessed on Jul. 21, 2015, 4 pages.
Strad Energy—Access Mats Product List, URL=http://www.stradenergy.com/productindex, accessed on Jul. 17, 2015, 1 page.
Strad Energy Services—400 BBL Tanks, URL=http://www.stradenergy.com/our-solutions/surface-equipment/8/400-bbl-tanks, accessed on Nov. 23, 2015, believed to be available before Sep. 28, 2015, 2 pages.
Dura-Base Mat System Brochure, published at least as early as Jul. 17, 2015, 7 pages.
Pond Life Forum, URL=https://www.pond-life.me.uk/forum/viewtopic.php?f=8&t=10714&start=10, published at least as aarly as Oct. 16, 2013, 9 pages.

* cited by examiner 24
26
38``A
38`A
36A
36B
40C
34C
34B
34A
40B
36
30`
38`B
30``

25
32
112
112
100
100
116
114
24
26
30`
30``
28

LIQUID CONTAINMENT STRUCTURES AND FRAC PONDS WITH MAT FOUNDATIONS

TECHNICAL FIELD

This document relates to liquid containment structures and frac ponds with mat foundations, and related methods.

BACKGROUND

A frac pond is a large above-ground structure for storing water, referred to as frac water, adjacent a well site for use in fracturing the formation penetrated by a well. Frac ponds are made of plural C-ring panels with heights of 3-4 m or higher, and a synthetic liner that sits atop a graded dirt, sawdust, or sand bed. Frac ponds are designed to hold volumes of 1000-15000 $m^3$ of water. Other mechanisms for storing frac water include a conventional tank farm.

SUMMARY

Containment structures and ponds for retention and storage of liquid, such as water, are disclosed, for example liquid used in the oil and gas industry. Some embodiments include a floating mat system underlying an above-ground, in some cases open-topped, containment structure. Others include a mat foundation with a recessed drain below a floor liner.

A liquid containment structure comprising: a perimeter wall forming a basin with an interior sidewall surface and a floor; a liner spread across the floor, up, and in some cases over the top edge of, the interior sidewall surface; and a platform underneath the liner, the platform formed of a network of mats.

A liquid containment structure is also disclosed comprising: a perimeter wall; a floor liner bounded by the perimeter wall; and a platform underneath the floor liner, the platform formed of a plurality of mats laid edge to edge and whose upper faces collectively define a support surface, the floor liner conforming to the shape of the support surface.

A method is also disclosed comprising: laying a plurality of mats edge to edge over a ground surface to form a platform; erecting a perimeter wall on, around, or on and around the platform; and installing a floor liner on the platform within an area bounded by the perimeter wall, in which the perimeter wall and floor liner form a liquid containment structure. The floor liner conforms to the shape of a support surface collectively defined by upper faces of the plurality of mats.

Cross laminated rig mats lacking connectors are also disclosed.

In various embodiments, there may be included any one or more of the following features: A drain channel is defined in the support surface below a portion of the floor liner, with the portion of the floor liner extending downward into the drain channel. The portion of the floor liner conforms to the shape of the drain channel. The drain channel is defined at least in part by a lateral gap between adjacent mats. The drain channel is defined at least in part by a channel member that has in cross section a pair of side walls and a channel base. The channel member has in cross section a pair of opposed laterally extending flanges, each flange extended from a respective side wall, and the flanges are secured to an underside of respective mats bordering the drain channel. The drain channel is collectively defined by a series of channel members connected end to end. A collective base, defined by respective bases of the series of channel members, slopes downward with decreasing distance from the perimeter wall. The collective base has an apex between axial ends of the collective base, and the collective base slopes downward from the apex towards each of the axial ends. Each axial end terminates prior to reaching the perimeter wall. The drain channel bisects a floor area bounded by the perimeter wall. The liquid containment structure is located adjacent a well site. The liquid containment structure forms a frac pond filled at least partially with water. The perimeter wall comprises a ring formed by plural arcuate wall parts. The platform has a rectangular shape, and the perimeter wall is erected on top of the platform. The plurality of mats float relative to one another. Each mat is formed of a plurality of layers stacked one on the other and laminated together, in which each layer comprises a plurality of boards laid edge to edge relative to one another. The liquid containment structure is assembled adjacent a well site, and well treatment liquid is stored within the liquid containment structure, and a fracturing operation is carried out on a formation penetrated by a well at the well site using the well treatment liquid. A kit for assembling the platform.

These and other aspects of the device and method are set out in the claims, which are incorporated here by reference.

BRIEF DESCRIPTION OF THE FIGURES

Embodiments will now be described with reference to the figures, which are not drawn to scale, in which like reference characters denote like elements, by way of example, and in which.

DETAILED DESCRIPTION

Immaterial modifications may be made to the embodiments described here without departing from what is covered by the claims.

In the conventional fracturing of wells, producing formations, new wells or low producing wells that have been taken out of production, a formation can be fractured to attempt to achieve higher production rates. Proppant and fracturing fluid are mixed in a blender and then pumped into a well that penetrates an oil or gas bearing formation. Various chemicals may be added to the fracturing fluid, such as gelling agents, breakers, activators, and surfactants. High pressure is applied to the well, the formation fractures and proppant carried by the fracturing fluid flows into the fractures. The proppant in the fractures holds the fractures open after pressure is relaxed and production is resumed. Conventional fracturing fluids include water, frac oil, methanol, and others, water being the least expensive and most commonly used option. A fracturing operation may require large amounts of water, and such volumes are stored or otherwise made accessible to the frac operator to ensure that the frac can be completed.

Figure 1:
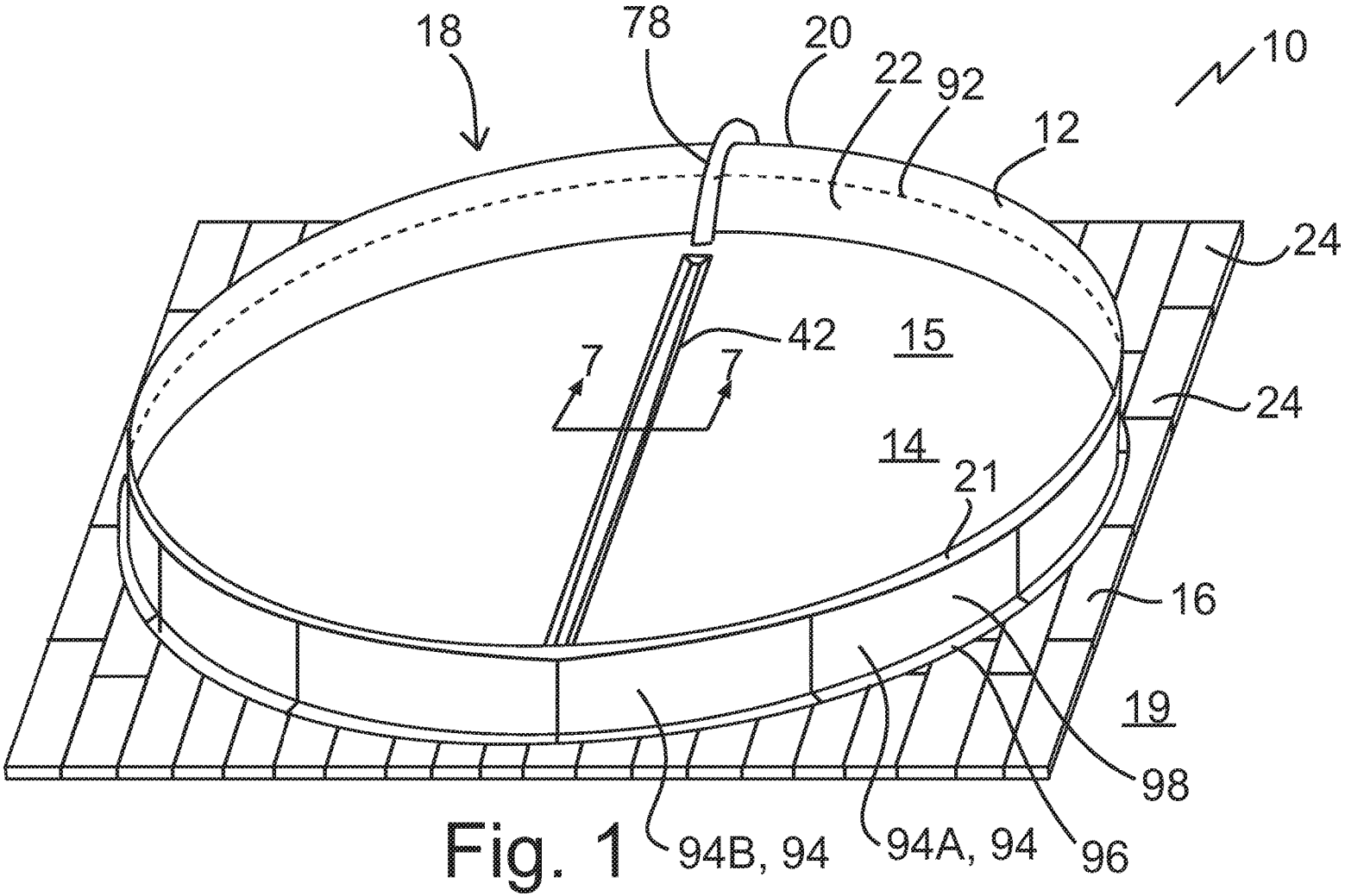
FIG. 1 is a perspective view of a liquid containment structure.

Referring to FIG. 1, a liquid containment structure, such as a frac pond 10, is illustrated. The pond 10 may have a perimeter wall 12, a floor liner 14, and a platform 16. The floor liner 14, which may be a synthetic geomembrane, may be bounded by the perimeter wall 12. The floor liner 14 may be part of a larger liner system 18 that extends up and in some cases over a top rim 20 of the perimeter wall 12. For example, liner system 18 includes floor liner 14 and a wall liner part 22. A top part 21 of the wall liner part 22 may wrap over top rim 20 and secure to the wall 12 in a suitable fashion such as using clamps or ties. The liner system 18 may be supplied to the site in one or more rolls, and may be assembled by unrolling or by fusing smaller sections or panels of membrane together.

Figure 2:
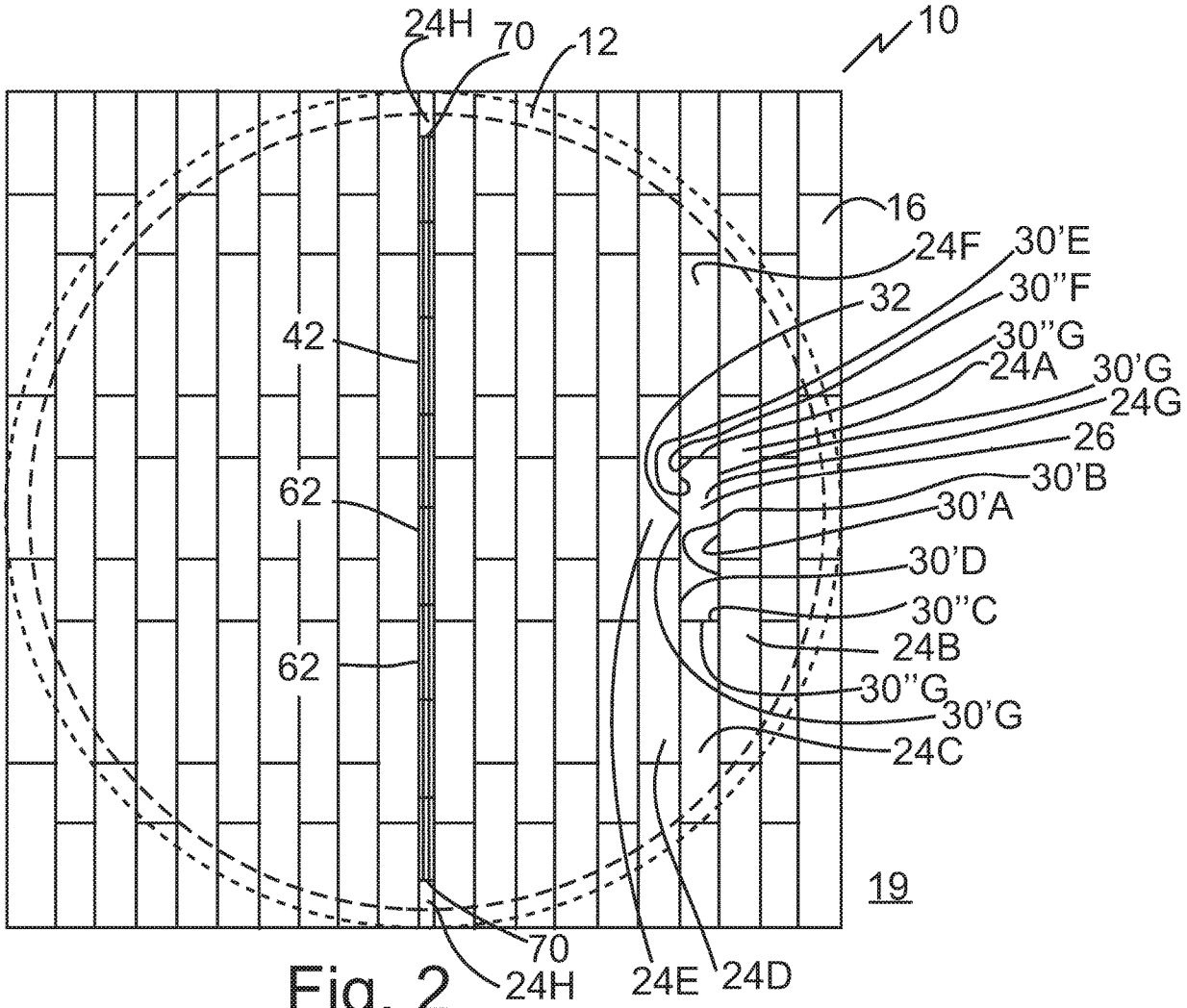
FIG. 2 is a top plan view of the structure of FIG. 1 with the liner removed and the perimeter wall shown in dashed lines, for clarity.
Figures 9, 9A:
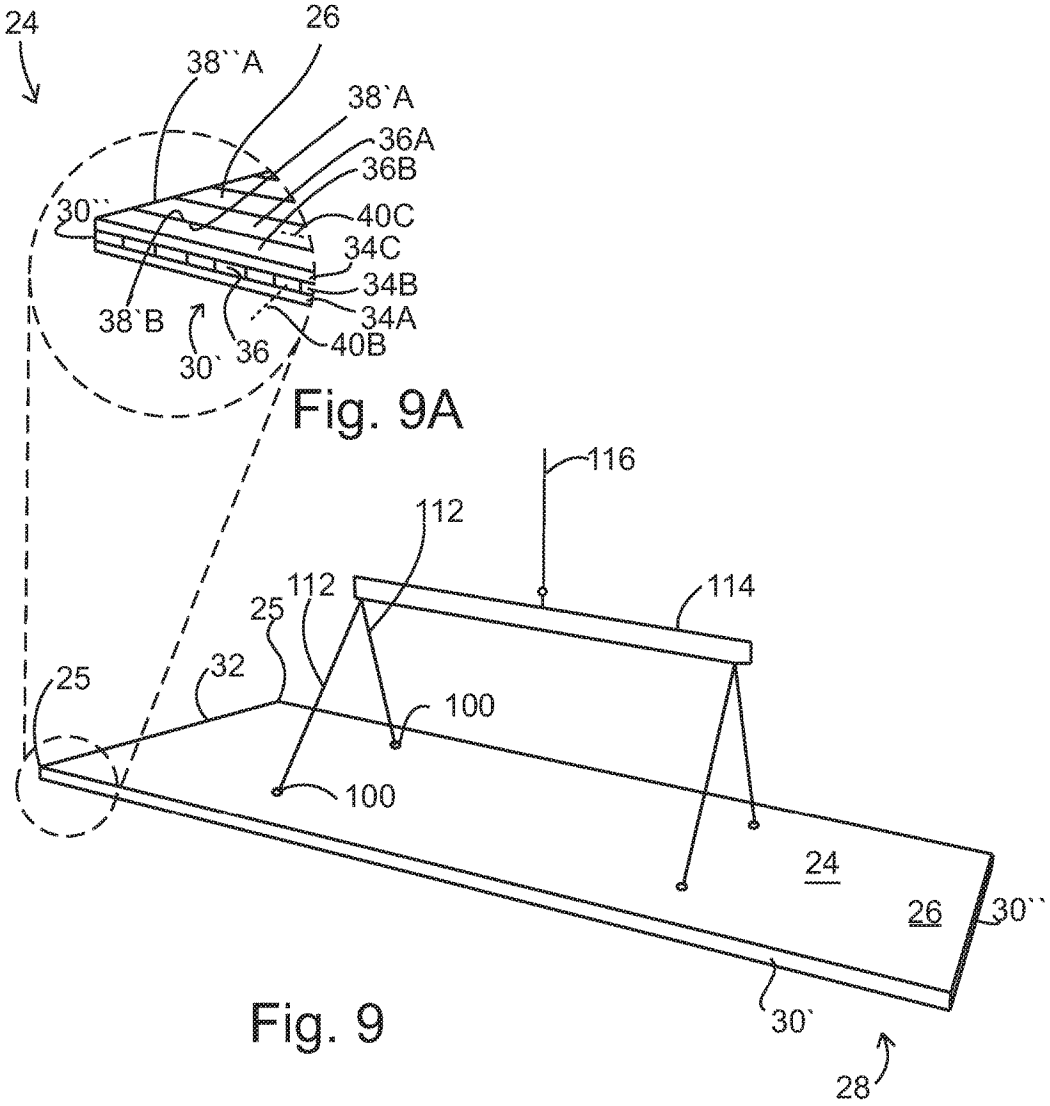
FIG. 9 is a perspective view of a method of lifting and positioning a mat used in the structure of FIG. 1.
FIG. 9A is a close-up perspective view of the area marked 9A from FIG. 9.

Referring to FIGS. 1 and 2, the platform 16 may be formed of a plurality of mats 24. Referring to FIGS. 2 and 9, each mat 24 may have a top face 26, a base face 28, and edges 30, such as side edges 30' and end edges 30", separating the faces 26 and 28. The faces 26 and 28 may define an outer perimeter 32 with a rectangular shape when viewed from above or below, although other shapes may be used. Referring to FIG. 2, the mats 24 may be laid edge to edge. For example, referring to the relationship between a mat 24G and adjacent mats 24A-F, the end edges 30"G of the mat 24G contact or otherwise sit in close proximity adjacent the end edges 30"F and 30"C of adjacent mats 24F and 24C, respectively. Similarly, the side edges 30'G of mat 24G may contact or otherwise sit in close proximity adjacent the side edges 30'A, 30'B, 30'D, and 30'E, of respective adjacent mats 24A, B, D, and E. When laid in place the mats 24 form a network as identified by the intersecting side and end lines of the edges of the mats.

The plurality of mats 24 may float relative to one another, for example if the side edges 30' and end edges 30" lack connectors to interconnect with adjacent mats on all edges. Thus, referring to mat 24G, there are no connector between mat 24G and adjacent mats 24A-F. By lacking connectors, the mats 24 float on the ground surface 19, and will each adopt a unique and distinct orientation depending on the grade and settling of the ground surface 19 underlying the respective mat 24. Theoretically, the floating of the mats 24 may lead to corners 25 (FIG. 9) of mat protruding above adjacent mats 24 and thus may lead to puncture of the floor liner 14 above the mat 24. However, the floating of the mats 24 is believed to actually reduce the occurrence of protrusions relative to a platform of interconnected mats. Such a result is believed to be due to the fact that in a floating platform settling effects under a mat 24 are confined to the respective mat 24, while in a platform of interconnect mats, settling effects under one mat necessarily translate to adjacent mats, which are chained to the respective mat. In practice the weight of the pond water 92 has been found to keep the mats 24 sufficiently level, and to reduce occurrence of corners protruding from settling action.

Referring to FIG. 9A, mats 24 may be formed of a plurality of layers, such as layers 34A, 34B, and 34C shown, stacked one on the other and laminated together, for example with hydrophobic adhesive such as a polyurethane adhesive. Each layer 34 may comprise a plurality of boards 36 laid edge 38 to edge 38 relative to one another so that the top and base faces of each mat may collectively define top and base surfaces, respectively. Each board 36 may have side edges 38', such as edges 38'A and 38'B of adjacent boards 36A and 36B, respectively. Each board 36 may also have end edges 38", such as end edges 38"A shown for board 36A. Each board 36 may define a longitudinal axis, with such axes, for example axes 40C, of boards 36 in each layer, such as layer 34C, arranged perpendicular to, or otherwise crossing, the longitudinal axes, such as axes 40B, of boards 36 in adjacent layers, such as layer 34B, in a configuration referred to as cross-lamination. The boards 36 in each layer may be arranged in an abutting relationship with adjacent boards, to avoid voids between the boards 36. Each layer, or in some cases only the top layer 34C, may be planed to provide a smooth top face 26 from edge to edge. Example boards that may be used include two by four or two by six wooden boards, although other suitable materials and sizes may be used. Mats 24 may lack a metal structural frame interior, and may be made of suitable wood such as Douglas Fir or Spruce Pine Fir. Once the layers are arranged and laminated, the mat 24 may be compressed in a press to reduce mat thickness and increase rigidity and strength. The top face 26 of each mat 24 may lack fasteners, such as screws, even ones that are countersunk to be flush with a plane defined by the top face 26. Other suitable materials, such as polymers, and other suitable designs, such as plural boards laminated together face to face and retained within an external support structure, may be used for mats 24.

Figure 7:
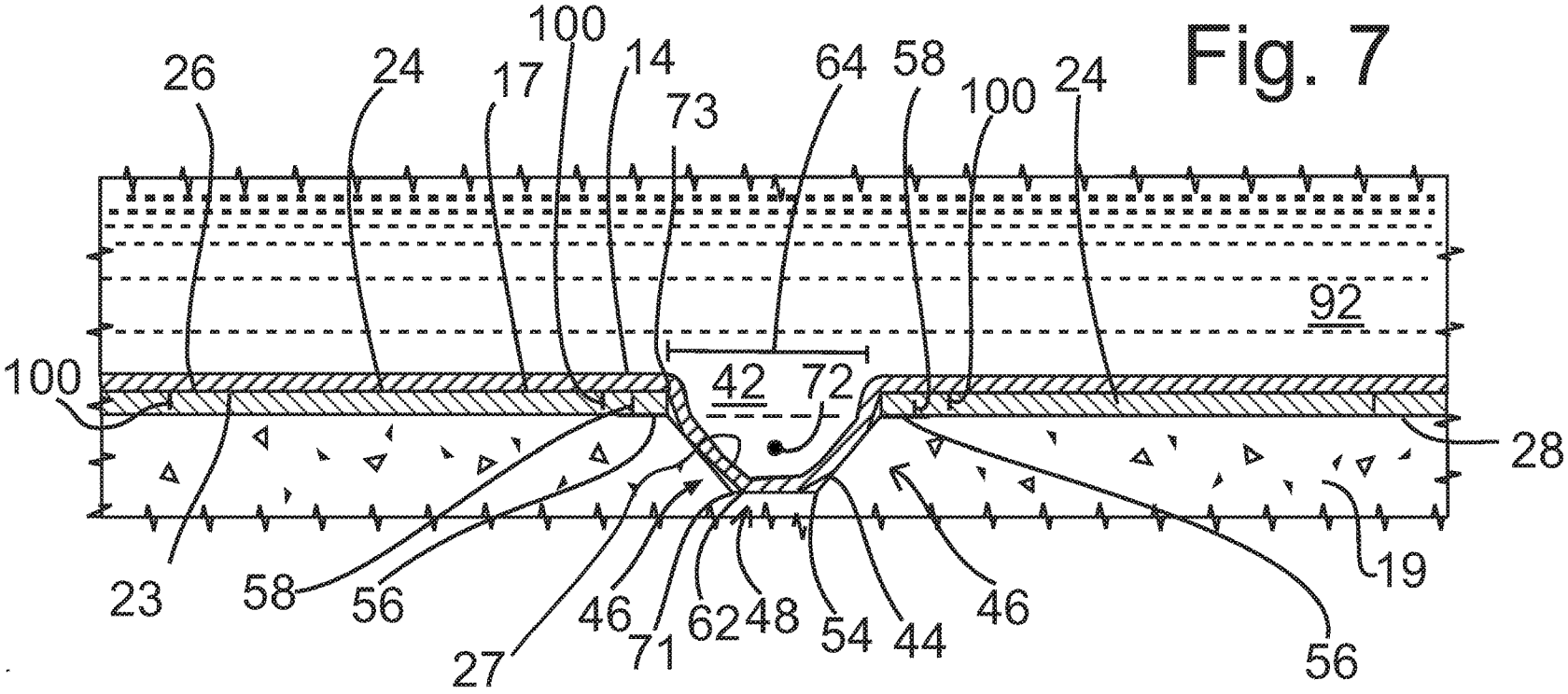
FIG. 7 is a section view taken along the 7-7 section lines from FIG. 1.

Referring to FIGS. 2 and 7, upper faces, for example top faces 26, may collectively define a support surface 17 for the liner 14. The rigid mats 24 may be arranged so that adjacent top faces 26 are flush with one another to provide a single contiguous support surface 17. The surface 17 is intended to have a planar shape but in practice will always have an undulating shape as a result of imperfectly planed grading below the mats 24.

Referring to FIG. 7, the floor liner 14, for example top face 27 of floor liner 14, may conform to the shape of the support surface 17. Conform is understood to mean that, at least under the hydrostatic pressure of liquid retained above the liner 14, the shape of the liner 14, for example at least a bottom face 23 of the liner 14 and in some cases the top face 27 of the liner 14, assumes and follows the shape of the support surface 17, for example in a fashion similar to the shape that a conformal coating may take on the top face 26, ignoring the gathering action of excess slack in the liner 14. For example the platform 16 may be located directly underneath the floor liner 14, such that the bottom face 23 rests directly upon the support surface 17. Nominal air gaps may be present between the liner 14 and support surface 17. In some cases a flexible material may be positioned between liner 14 and support surface 17. In either case, the shape of the support surface 17 may dictate the shape of the liner 14.

The liner 14 may be made of flexible material. The liner 14 may comprise two or more layers of material, and is liquid impervious in order to contain liquid within the structure 10. The liner 14 may be resistant to damage from ultraviolet light. The liner 14 may comprise a polymeric material, such as polyethylene. The thickness of the liner 14 may vary, for example between 1 and 50 mm, though other suitable thicknesses may be used. The liner 14 may be treated to resist damage from sharp objects. The entire liner system 18 may be made of the same material, and when installed may comprise a single integral liner. The elastomeric membrane or liner 14 may be formed of plural sheets or panels adhered or welded together at overlapping seams by a suitable adhesive, with such connection being applied on site or off site prior to install. The liner 14 may be a rubber liner.

Referring to FIGS. 1, 2, and 7, a drain channel 42 may be defined in the support surface 17. Referring to FIG. 7, the drain channel 42 may be below a portion 44 of the floor liner 14. The portion 44 of the floor liner 14 may extend downward into the drain channel 42, for example so that the portion 44 conforms to the shape of the drain channel 42. The drain channel 42 may be defined at least in part by a lateral gap 64 between adjacent mats 24.

The drain channel 42 may be defined at least in part by a channel member 62. The channel member 62 may have, in cross section relative to a drain axis 72, a pair of side walls 46, a channel base 48, and in some cases mat fastening elements such as a pair of opposed laterally extending flanges 56. The side walls 46 and base 48 are illustrated as being formed by straight pieces of material with clear transitions, although other suitable shapes are possible, including a U-shape where there is no clear boundary between the side walls 46 and base 48. Each flange 56 may be extended from a respective side wall 46. The flanges 56 may be secured, for example by passing fasteners 58 through holes 60 in flanges 56 and into respective holes in mats 24, to an underside/base face 28 of respective mats 24 bordering the drain channel 42. Other suitable securing methods may be used, including securing the flanges 56 over the top faces 26 of the mats 24. In some cases loose alignment mechanisms are used such as dowels within aligned holes or slots, and in other cases no securing method is used and the drain channel 42 is laid within a correspondingly shaped channel within the ground surface 19 and permitted to float relative to the mats 24.

Figure 3:
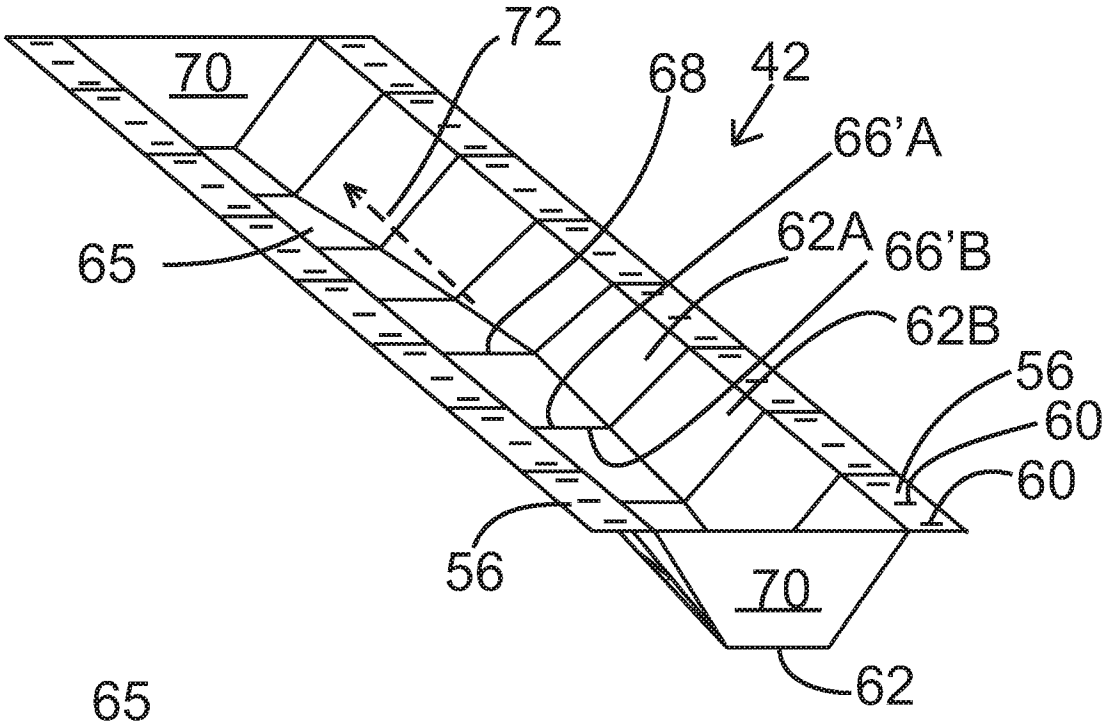
FIG. 3 is a perspective view of a drain channel used in the structure of FIG. 1.
Figure 4:
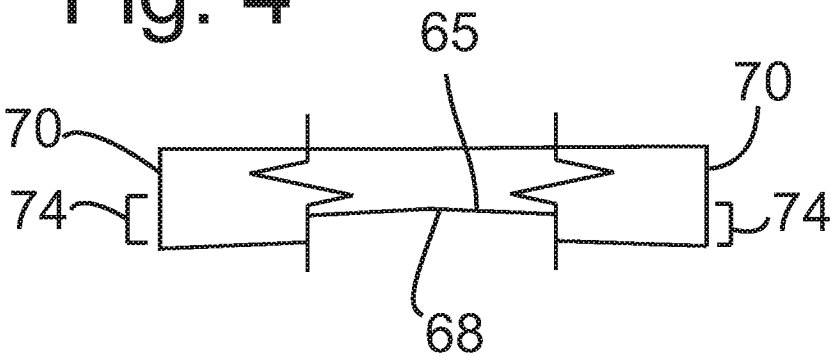
FIG. 4 is a side elevation section view taken along the drain axis of the drain channel of FIG. 3 from end to apex to end.
Figure 5:
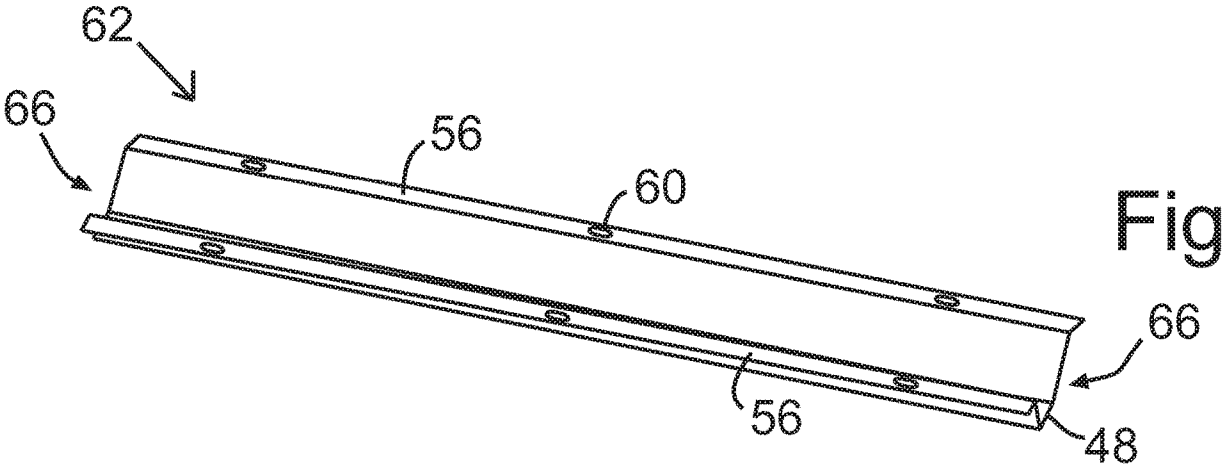
FIGS. 5-6 are perspective and top plan views of a channel member of the drain channel of FIG. 3.
Figure 6:
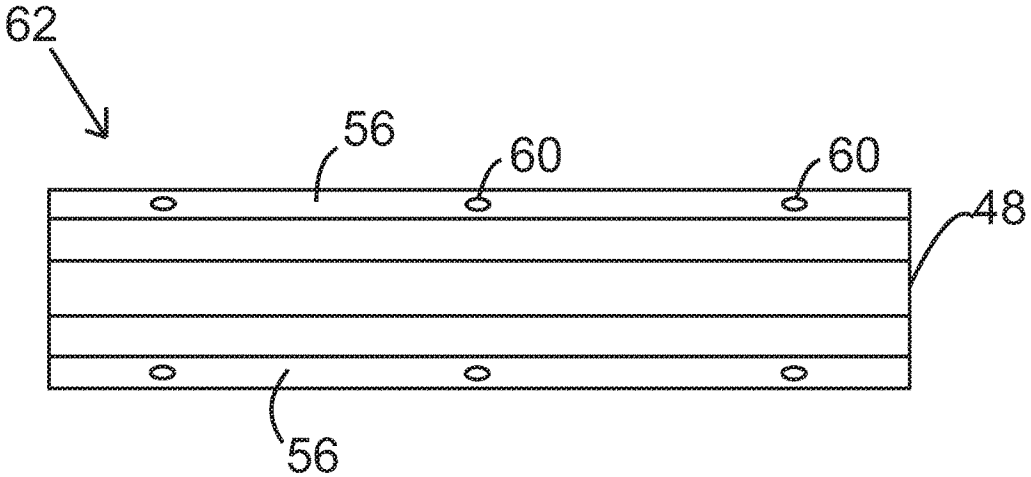

Referring to FIGS. 2 and 3 the drain channel 42 may be collectively defined by a series of channel members 62 that are connected end to end. Referring to FIG. 5, each channel member 62 has opposed axial ends 66. Referring to FIG. 3, axial ends, for example ends 66'A and 66'B of respective members 62A and 62B, may abut or overlap one another along the drain axis 72. Adjacent channel members 62 may connect to one another. Referring to FIG. 3, a collective base 65 may be defined by respective bases 48 of the series of channel members 62. Referring to FIGS. 1, 3 and 4, the collective base 65 may slope downward with decreasing distance from the perimeter wall 12. Sloping is understood to be defined such that when the structure 10 is deployed in the field, the downward slope is downward in a vertical direction to permit gravity to draw liquids down to pool at the axial ends 70 of the drain channel 42. Thus, the drain channel 42 increases in depth the closer the channel 42 gets to the perimeter wall 12. Referring to FIGS. 3 and 4, the collective base 65 may have an apex 68 between axial ends, defined in this case by end plates 70, of the collective base 65. The collective base 65 may slope downward from the apex 68 towards each of the axial ends 70. Referring to FIG. 4 the increases in depth over the span of base 65 from apex 68 to each end plate 70 is illustrated by reference numeral 74.

A drain channel 42 with an apex and dual sloped sections may be used to channel liquid toward each end plate 70, where the liquid can then be removed from the structure 10 at a location adjacent the end plate 70. Thus, the water may be removed by pumping or draining from two outlet locations at once. The channeling effect may be achieved with only a single sloped section, for example where the apex 68 is located at or near one of the end plates 70. A suitable slope may be used, for example with less than or equal to a 1.0% drop in slope.

Referring to FIG. 2, each axial end 70 may terminate prior to reaching the perimeter wall 12, for example if end plates 70 abut mats 24H as shown. Referring to FIG. 1, terminating the drain channel 42 prior to the wall 12 avoids potential complications that may arise from placing the wall 12 over a void created by a drain channel 42 that runs underneath the wall 12. In other cases the channel 42 may run under the wall 12, for example to an outlet. A hose or pipe 78 or other suitable outlet may be used to withdraw liquid from the structure 10.

Referring to FIG. 2, the drain channel 42 may bisect a floor area 15 bounded by the perimeter wall 12. Other suitable arrangements and orientations of channel 42 may be used, for example a cross-shaped channel 42, or plural channels 42 running parallel or at other angles relative to one another. Referring to FIG. 7, when laying out the liner 14 over the support surface 17, extra slack may be provided over the drain channel 42 to provide sufficient extension of portion 44 into the drain channel 42. The weight of liquid, such as water 92, stored in the structure 10 presses down on the portion 44 during use, and forces the portion 44 to conform to the shape of the drain channel 42. Air gaps 54 may form between the channel 42 and liner 14. The side walls 46 and base 48 of the channel 42 may be concavely shaped when viewing the interior of the drain channel 42. The walls 46 may be pitched at relatively shallow angles such as obtuse angles formed between walls 46 and base 48. The drain channel 42 may have rounded transitions 71 between parts, in order to reduce the chance of puncturing the liner 14. The top corner edges 73 of mats 24 may be rounded for the same reason.

Figure 10:
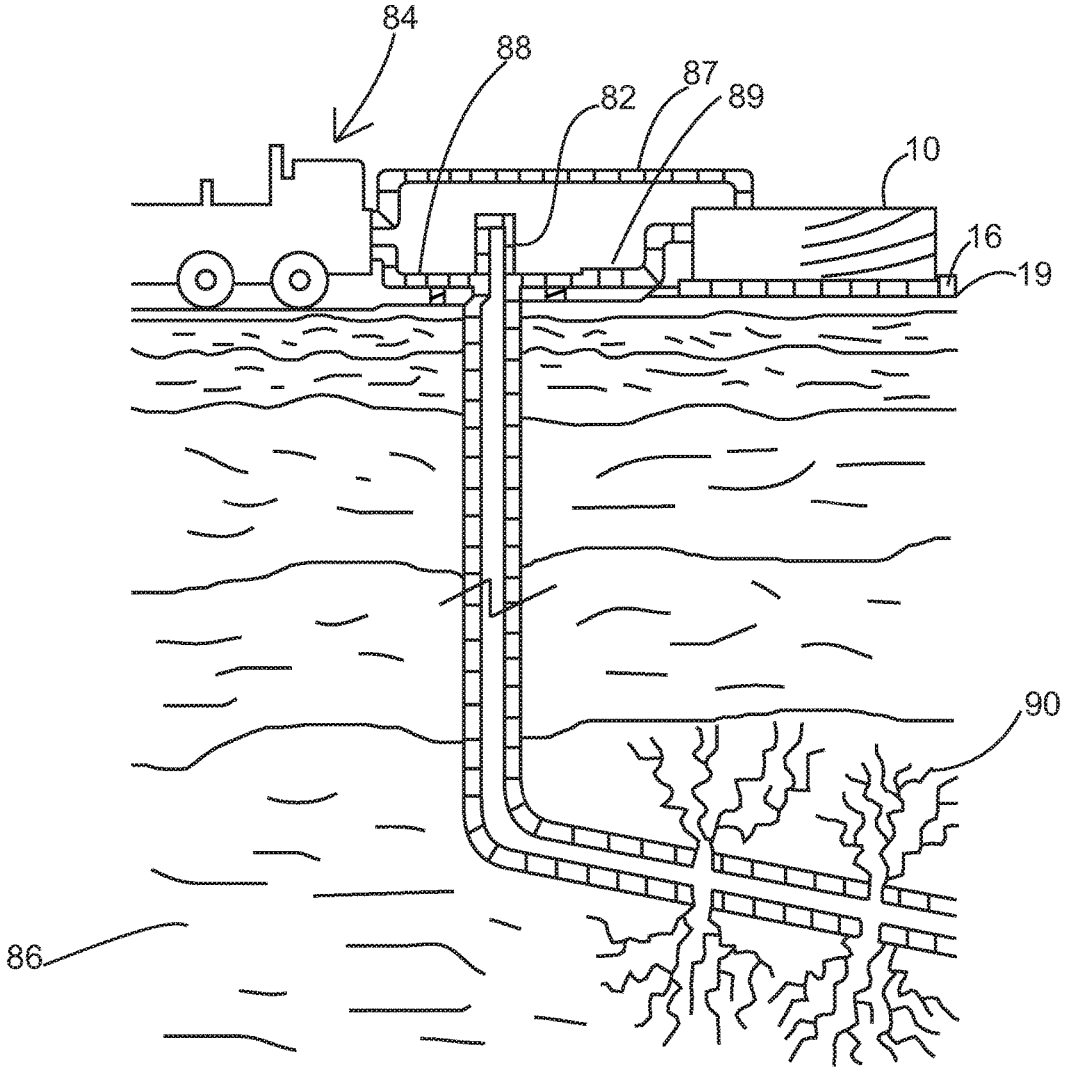
FIG. 10 is a side elevation view of a method of fracturing a formation penetrated by a well.

Referring to FIGS. 1 and 10, the structure 10 may be assembled as follows. In one case the structure 10 is assembled adjacent a well site, for example where a well 82 penetrates a hydrocarbon bearing formation 86. Referring to FIG. 1 a plurality of mats 24 may be laid edge to edge over a ground surface 19, for example a graded surface of compacted earth or a surface of earth that has had the subsurface removed to form a relatively level horizontal plane.

Figure 8:
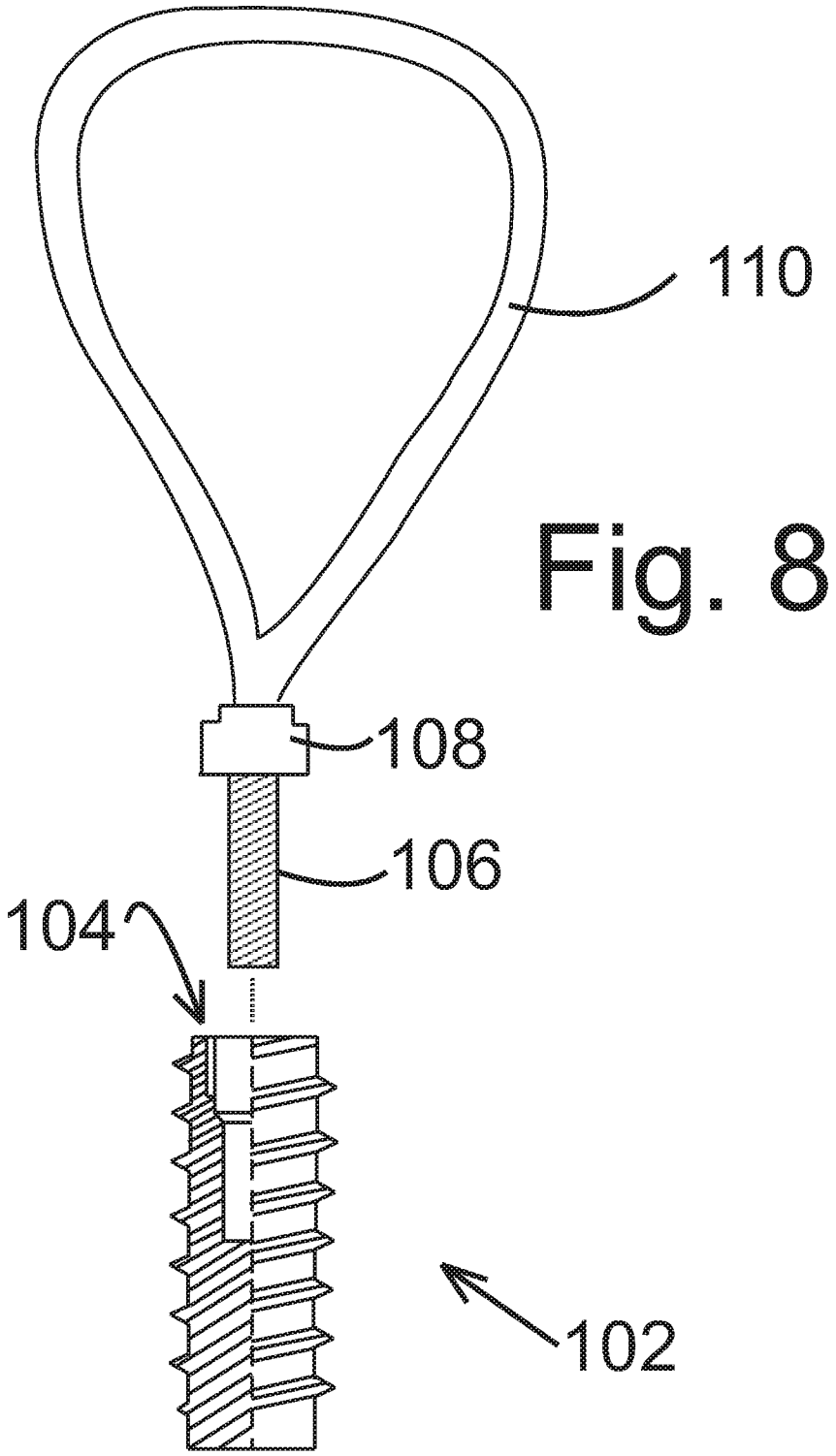
FIG. 8 is a side elevation partial section view of a hook and set screw lifting system.

Referring to FIG. 9, the mats 24 may be laid by a suitable method, for example by lifting with a crane cable 116. As shown, cable 116 connects to a beam 114, which connects by cables 112 to four lifting points defined by holes 100 penetrating the top face 26 of mat 24. Other suitable numbers of lifting points may be used. Referring to FIG. 8, lifting devices, such as comprising set screw 102, may be located within holes 100. Screw 102 may penetrate up to the lowest layer 34A of mat 24, in some cases without penetrating out of the base face 28 of mat 24. Set screw 102 may have an interior bore 104 threaded to receive a male threaded part 106 depending from a base 108 that mounts a lifting loop 110, which may be connected to cables 112 (FIG. 9) to lift the mat 24. Such a lifting device may be provided by a RAMPA™ insert. After lifting the mat 24 into place, the part 106 may be unthreaded from the screw 102, leaving the screw 102 behind in the mat 24, with the screw 102 being recessed below the support surface 17 to avoid protruding into the liner 14. In other cases the set screw 102 is also removed prior to laying the floor liner 14 overtop.

Referring to FIG. 1, the perimeter wall 12 may be erected on as shown, around, or on and around the platform 16. In the example shown the wall 12 has the shape of a ring, which is formed by assembling of a series of plural arcuate wall parts 94, such as parts 94A and 94B. Each part 94 may be lifted and maneuvered into place, for example using a forklift, picker, or crane, and each C-ring part 94 may be secured to adjacent parts 94 to provide a secure structure. Each part 94 may have an upstanding vertical part 98 and a base flange part 96 extended laterally from part 98 for providing stability to the part 94 and the wall 12 itself.

The foundation pad 16 may have a rectangular shape, and the perimeter wall 12 may be erected on top of the platform 16. The combination of a ring-shaped wall 12 and square platform 16 creates areas at the corners of the platform 16 that may be used to form a foundation for other equipment, such as equipment related to the function of the structure 10. In other cases the platform 16 may have a shape that corresponds to the shape of the wall 12, for example a circular shape with a diameter sufficient to extend to or past base flanges 96 of the wall 12, or a shape that extends to but not under the wall 12 in order to support the floor liner 14 but not the wall 12.

The floor liner 14 may be installed on the platform 16 within an area 15 bounded by the perimeter wall 12, in which the mats 24, perimeter wall 12, and floor liner 14 form the liquid containment structure or basin 10. If a wall liner 22 is used the wall liner 22 may be secured to the wall 12. Once assembled the structure 10 may be filled with liquid, such as water, thus forming a primary containment structure or pond.

Referring to FIG. 10, the structure 10 may form a frac pond filled at least partially with water. Water is one example of well treatment liquid that may be stored within the liquid containment structure 10. A fracturing operation may be carried out on a formation 86 penetrated by well 82 at the well site using the frac water in pond 10. Fracturing equipment 84, such as pumps, gel trucks, controllers, blenders, proppant trucks, fluid lines, and other suitable equipment may be used to carry out the frac. Lines 87 convey frac water to the equipment 84, while lines 88 convey liquid into and in some cases out of the well 82. During the fracturing operation, well treatment liquid is injected and pressured up above the fracturing threshold of the formation 86, in order to form fractures 90, into which injected proppant remains after pressure reduction in order to prop up and retain permeability through fractures 90. Flowback water may be sent via lines 89 to pond 10, and such flowback may be treated, for example recycled, to remove contaminants prior to or after storage in structure 10. Flowback may be trucked off-site and disposed of, or injected into an injection well.

End plates or axial ends 70 may incorporate ports, such as outlets to the exterior of the pond 10. In some cases ground cover mats 24 may interconnect with one another, for example by the use of mating fingers, tongue and groove, or other interconnection systems. In some cases no channel members 62 are used, for example if a channel 42 is dug within ground surface 19 and mats 24 laid with a gap 64 across the channel 42. In some cases the mats 24 may have dimensions of up to forty feet long, with widths, such as eight feet, sized to fit on a conventional semi-trailer, without requiring a pilot vehicle or wide load precautions to be taken. Holes 60 in channel members 62 may form slots to permit lateral play with fasteners. The drain channel 42 may be defined by aligned channels within the top faces 26 of adjacent mats 24. Insulation may be provided in wall 12 to limit heat transfer between the ambient environment and water 92.

Unless context dictates otherwise, words such as vertical, horizontal, top, bottom, base, lateral, and other such descriptive words are intended to have relative meanings, and are not restricted to absolute orientations defined with respect to the direction of gravity on the surface of the earth. The wall 12 may be installed after or during the installation of the liner 14 in some cases. Although a rectangular shaped platform 16 is shown, other suitable shapes are possible such as polygons, circles, ovals, and others. Mats and wall parts may be lifted by other suitable methods such as by grappling with an excavator or loader. The pond 10 may incorporate a lid, such as a floating lid (not shown). The ground surface below the platform may be sloped towards the drain channel to channel fluids to the drain channel.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A liquid containment structure comprising:

a perimeter wall;

a floor liner bounded by the perimeter wall;

a platform underneath the floor liner, the platform formed of a plurality of mats laid edge to edge and whose upper faces collectively define a support surface, in which the floor liner conforms to a shape of the support surface; and in which a drain channel is defined in the support surface below a portion of the floor liner, with the portion of the floor liner extending downward into the drain channel such that a top face of the floor liner follows a shape of the drain channel.

2. The liquid containment structure of claim 1 in which the portion of the floor liner conforms to the shape of the drain channel.

3. The liquid containment structure of claim 1 in which the drain channel is defined at least in part by a lateral gap between adjacent mats.

4. The liquid containment structure of claim 1 in which the drain channel is defined at least in part by a channel member that has in cross section a pair of side walls and a channel base.

5. The liquid containment structure of claim 4 in which the channel member has in cross section a pair of opposed laterally extending flanges, each flange extended from a respective side wall, and the flanges are secured to an underside of respective mats bordering the drain channel.

6. The liquid containment structure of claim 4 in which the drain channel is collectively defined by a series of channel members connected end to end.

7. The liquid containment structure of claim 6 in which a collective base, defined by respective bases of the series of channel members, slopes downward with decreasing distance from the perimeter wall.

8. The liquid containment structure of claim 7 in which the collective base has an apex between axial ends of the collective base, and the collective base slopes downward from the apex towards each of the axial ends.

9. The liquid containment structure of claim 8 in which each axial end terminates prior to reaching the perimeter wall.

10. The liquid containment structure of claim 1 in which the drain channel bisects a floor area bounded by the perimeter wall.

11. The liquid containment structure of claim 1 located adjacent a well site.

12. The liquid containment structure of claim 11 forming a frac pond filled at least partially with water.

13. The liquid containment structure of claim 1 in which the perimeter wall comprises a ring formed by plural arcuate wall parts.

14. The liquid containment structure of claim 13 in which the platform has a rectangular shape, and the perimeter wall is erected on top of the platform.

15. The liquid containment structure of claim 1 in which the plurality of mats float relative to one another.

16. The liquid containment structure of claim 1 in which each mat is formed of a plurality of layers stacked one on the other and laminated together, in which each layer comprises a plurality of boards laid edge to edge relative to one another.

17. A method comprising:

laying a plurality of mats edge to edge over a ground surface to form a platform;

erecting a perimeter wall on, around, or on and around the platform;

installing a floor liner on the platform within an area bounded by the perimeter wall, the floor liner conforming to a shape of a support surface collectively defined by upper faces of the plurality of mats, in which the mats, perimeter wall and floor liner form a liquid containment structure; and in which a drain channel is defined in the support surface below a portion of the floor liner, with the portion of the floor liner extending downward into the drain channel such that a top face of the floor liner follows a shape of the drain channel.

18. The method of claim 17 in which the liquid containment structure is assembled adjacent a well site, and further comprising:

storing well treatment liquid within the liquid containment structure; and carrying out a fracturing operation on a formation penetrated by a well at the well site using the well treatment liquid.

* * * * *